US006340960B1

(12) United States Patent
Song et al.

(10) Patent No.: US 6,340,960 B1
(45) Date of Patent: Jan. 22, 2002

(54) CIRCUIT AND METHOD FOR DRIVING PLASMA DISPLAY PANEL

(75) Inventors: Young Bok Song; Jae Hyuck Lee; Moon Shick Chung, all of Kyungsangbuk-do; Nam Kyu Lee, Taegu-kwangyoksi, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/253,730

(22) Filed: Feb. 22, 1999

(30) Foreign Application Priority Data

Feb. 24, 1998 (KR) ..... 98-5844
Mar. 17, 1998 (KR) ..... 98-9006
Nov. 3, 1998 (KR) ..... 98-47018

(51) Int. Cl.[7] ..... G09G 3/28
(52) U.S. Cl. ..... 345/60; 345/213
(58) Field of Search ..... 345/60, 63, 67, 345/68, 208, 211, 214, 215; 348/687, 797; 315/169.4

(56) References Cited

U.S. PATENT DOCUMENTS 5,475,448 A * 12/1995 Saegusa ..... 348/797
5,995,069 A * 11/1999 Tokunaga et al. ..... 345/60
6,091,380 A * 7/2000 Hashimoto et al. ..... 345/60

FOREIGN PATENT DOCUMENTS

JP 01233492 A 9/1989
JP 02291597 A 3/1990
JP 03125187 A 5/1991
JP H3-125787 * 5/1991 ..... G09G/3/28
JP 04018594 A 1/1992
JP 06004039 1/1994
JP 07261700 10/1995
JP 08305320 11/1996
JP 0930054 12/1997
JP 10260655 9/1998
JP 11065486 3/1999

* cited by examiner

*Primary Examiner*—Richard Hjerpe
*Assistant Examiner*—Alexander Eisen
(74) *Attorney, Agent, or Firm*—Fleshner & Kim, LLP

(57) ABSTRACT

Circuit and method for driving a plasma display panel, the method including the steps of (1) applying first scan pulses to a first driving block, which is any one of the driving blocks, in every given driving cycle starting from a first scan electrode line to (n)th scan electrode line in succession, and (2) applying second scan pulses each having a given application time difference from the application time of the first scan pulse to a second driving block adjacent to the first driving block starting from (m)th scan line to a first scan line in a reverse sequence to the first scan pulses, whereby preventing an occurrence of flicker because interfaces between driving blocks are continuous with respect to and providing a PDP having a resolution better than an HDTV because intervals of scan pulse application to adjacent lines are short.

32 Claims, 14 Drawing Sheets

CIRCUIT AND METHOD FOR DRIVING PLASMA DISPLAY PANEL

BACKGROUND OF THE INVENTION

1. Field of the Invention

The present invention is related to a plasma display panel, and more particularly, to circuit and method for driving a plasma display panel.

2. Background of the Related Art

The plasma display panel and Liquid Crystal Display (LCD) are spotlighted as next generation displays of the greatest practical use, and, particularly, the plasma display panel has wide application as a large sized display, such as an outdoor signboard, a wall mounting type TV, a display for a movie house because the plasma display panel has a higher luminance and a wide angle of view than the LCD. FIG. 1 illustrates a system of a related art plasma display panel with a resolution of 640×480.

Referring to FIG. 1, the related art plasma display panel is provided with a panel having 640×'address electrode lines R1, G1, B1, R2, G2, B2, . . . , R639, G639, B639, R640, G640, B640, 480 scan electrode lines S1, S2,. . . , S480 vertical to the address electrode lines, and sustain electrode lines 15 of the same number as the scan electrode lines, an address electrode driving unit 50 for applying data pulses to the address electrode line 17, a scan electrode driving unit 30 for applying scan pulses and sustain pulses to the scan electrode line 14, a sustain electrode driving unit 60 for applying the sustain pulses to the sustain electrode line 15, and a microcomputer 20 for controlling the address electrode driving unit 50, the scan electrode driving unit 30, and the sustain electrode driving unit 60. As shown in FIG. 2*a*, the panel is provided with an upper substrate 10 and a lower substrate 10', both of which are bonded together facing each other. FIG. 2*b* illustrates a section of the panel illustrated in FIG. 2*a*, with the lower substrate turned an angle of 90° with reference to an axis vertical to a substrate plane for convenience of explanation. The upper substrate 10 is provided with successive sets of the scan electrode lines 14, each having a transparent electrode 14' and a metal electrode 14"; and the sustain electrode lines 15, each having a transparent electrode 15' and a metal electrode 15", a dielectric layer 11 coated on the upper substrate having the scan electrodes and the sustain electrodes formed thereon, and a protection film 12 coated on the dielectric layer 11. And the lower electrode 10' is provided with the address electrode lines 17 formed to cross the scan electrodes and the sustain electrodes, and a lower dielectric layer 18 coated on the lower substrate having the address electrode formed there under. And, there is a partition wall 19 formed between every region of the dielectric layer the address electrode lines 17 formed therein, and a fluorescent material film 13 coated on portions of the partition walls and the region of the lower dielectric layer under which the address electrode is formed. An inert gas is sealed in a space between the upper substrate and a lower substrate, to form a discharge region. Each of the address electrode lines 17 is formed continued on the lower substrate 10', and, as shown in FIG. 2*a*, the partition wall 19 separates adjacent address electrode lines. As shown in FIG. 1, in a case of a color plasma display panel, the address electrode lines 17 are formed such that one set composed of adjacent three address electrode lines R1, G1, B1 forms one pixel. The one set of three address electrode lines 17 are adapted to be applied of data pulses for R(Red), G(Green), and B(Blue) video signals, respectively. The scan electrode lines S1, S2, S3,. . . , S480, 14 and the sustain electrode lines 15 are formed to cross the address electrode lines 17 on the upper substrate 10 disposed to face the lower substrate 10', for being applied of sustain pulses as shown in FIG. 3. The sustain pulses applied to the scan electrode lines and the sustain electrode lines have opposite phases and the same frequencies. The microcomputer 20 receives a video signal and a clock signal and the like, and controls the address electrode driving unit 50, the scan electrode driving unit 30, and the sustain electrode driving unit 60 to realize an image of the video signal on the panel. The address driving unit 50, synchronous to the scan pulses, applies data pulses for the video data from the microcomputer to all address electrode lines 17 on the same time. The address electrode driving unit 50 receives the video data, and provides data pulses for selective discharge of the discharge cells. The data pulses for application to the address electrode lines 17 are illustrated in FIG. 3. The scan electrode driving unit 30 applies scan pulses to the scan electrode lines S1, S2, . . . , S480 in succession in response to a control signal from the microcomputer 20 while the sustain electrode driving unit 60 applies sustain pulses to all the sustain electrode lines 15. The control signal applied in this instance is in general called a 'BLANK' signal. The scan electrode driving unit 30 provides no scan pulses when the control signal is '0', and provides the scan pulses when the control signal is '1'. The sustain pulses and the scan pulses applied to the scan electrode lines S1, S2, . . . , S480 is illustrated in FIG. 3. The sustain electrode driving unit 60 applies sustain pluses to all of the sustain electrode lines 15 at the same time. The sustain pulses applied to the sustain electrode lines have a phase opposite to a phase of the sustain pulses applied to the scan electrode lines 14. The plasma display panel is driven by discharges occurring among the electrodes, which are divided into a reset discharge period in which each of the discharge cells in the plasma display panel are initialized in response to the pulses applied to each electrode, an address discharge period in which each of the discharge cells are scanned line by line selectively, and a sustain discharge period in which a discharge in the discharge cell scanned during the address discharge period is sustained. The plasma display panel may be either a selective erasure method or a selective write method depending on characters of the discharge cell scanning in the address discharge period.

The method for driving the plasma display panel in the selective write method will be explained. During the reset discharge period, all the scan electrodes 14 and the sustain electrodes 15 in the plasma display panel are applied of a discharge voltage to cause a primary discharge in discharge regions of the discharge cells, which in turn erases all wall charges formed on the dielectric layer on the scan electrodes 14 and the sustain electrodes 15 and 15'. As explained, sustain pluses are always applied to the scan electrodes 14 and 14' and the sustain electrodes 15. However, because a voltage of the sustain pulses applied to the scan electrodes 14 and 14' and the sustain electrodes 15 and 15' is lower than a discharge initiation voltage which initiates a discharge, the discharge regions in the discharge cells make no discharges. As shown in FIG. 3, the scan electrode lines 14 are applied of scan pluses in succession for one cycle of the sustain pulses. In this instance, the address electrode driving unit 50 applies data pulses to the address electrode line 17 connected to the discharge cell to be discharge according to the video data provided from the microcomputer 20. As a result, a discharge is induced in the discharge cell of the discharge cells connected to the scan electrode lines 14 applied of the scan pulses at a portion crossing the address electrode line 17 applied of data pulses, to generate a wall charge at a surface of the dielectric layer on the scan electrode 14 and the sustain electrode 15 in the discharge cell. That is, while one scan pulse is applied to one scan electrode line 14, the address electrode driving unit 50 applies data pulses determining discharge of the discharge cells connected to the one scan electrode line 14 on the same time according to the video data of one line amount provided form the microcomputer 20. For example, if it is intended to form white on all pixels connected to the one scan electrode line 14, data pulses are provided to all address electrode lines 17, to cause discharge in all the discharge cells on the one line. In this instance, it is impossible to apply scan pulses to all the scan electrode lines 14 for one cycle of the sustain pulses. Because, in order to apply scan pulses to all the scan electrode lines 14 for one cycle of the sustain pulses, intervals of the data pulses applied to the address electrode 17 would be excessively short, which may make the discharge operation unstable, inducing no discharge of the discharge cells. Therefore, the related art plasma display panel is provided with the scan electrode driving unit 30 having many driving IC's each connected to about 40 to 120 scan electrode lines 14. And, the related art plasma display panel has a scan pulse application interval set therein such that approximately 4 data pulses are applied for one cycle of the sustain pulses.

The sustain pulses, the scan pulses, and the data pulses respectively applied during the reset discharge period, the address discharge period, and the sustain discharge period have waveforms as illustrated in FIG. 3.

The operation principle of the plasma display panel in the selective erasure method will be explained. Pulses applied to respective electrodes in the plasma display panel according to the selective erasure method are illustrated in FIG. 4.

Write pulses are applied to the scan electrodes 14, added to the sustain pulses. Then, a voltage from the write pulse and the sustain pulse to the sustain electrode 15 induces a discharge in a discharge region between the sustain electrodes 15 and the scan electrodes 14. Because a voltage between the scan pulse for the scan electrodes and the sustain pulse for the sustain electrodes is higher than the discharge initiation voltage, a wall charge is induced on the dielectric layer 11 on the sustain electrodes and the scan electrodes. As shown in FIG. 4, the scan electrode lines 14 are applied of scan pulses in succession for one cycle of the sustain pulses. In this instance, the address electrode driving unit 50 applies data pulses to the address electrode 17 connected to the discharge cell to be discharged according to the video data provided from the microcomputer 20. As a result, a discharge is induced in the discharge cell of the discharge cells connected to the scan electrode lines 14 applied of the scan pulses at a portion crossing the address electrodes 17 applied of data pulses, to erase a wall charge formed at the dielectric layers on the scan electrode 14 and the sustain electrode 15 in the discharge cell. That is, while one scan pulse is applied to one scan electrode line 14, the address electrode driving unit 50 applies data pulses determining discharge of the discharge cells connected to the one scan electrode line 14 on the same time according to the video data of one line amount provided from the microcomputer 20. For example, if it is intended to form white on all pixels connected to the one scan electrode line 14, data pulses are not provided to all address electrode lines 17 in the address electrode driving unit 50 in a plasma display panel of the selective erasure method. Opposite to this, if it is intended to form black on all pixels connected to the one scan electrode line 14, data pulses are provided to all address electrode lines 17. That is, in view of forming a portion of an image in one discharge cell, the selective write method induces a discharge in the discharge cell by the data pulses, and the selective erasure method stops a discharge in the discharge cell by the data pulses. Of the methods, in view of composing one frame of image, generally employed for forming an image on an entire display region of the plasma display panel utilizing the portions of the images in each discharge cells is a sub-field method illustrated in FIG. 5. In the sub-field method, one image displayed by the selective write method or the selective erasure method is set as one sub-field, and a number of the sub-fields are overlapped by controlling the scan electrode driving unit 30, the sustain electrode driving unit 60, and the address electrode driving unit 50, to form one complete frame. In this sub-field method, it is required to gather a number of sub-fields in succession to form one frame, of which number is the same with a number of bits of gradation of the image. That is, if one frame of image is formed on the screen in 8 bits of gradation, the number of sub-fields formed according to the sub-field method is also 8. In the sub-field method, a voltage coming from one bit of digital video signal is applied to all cells in the plasma display panel, to form a first sub-field in which all cells have the same luminances. Then, a voltage coming from the next bit of digital video signal is applied, to form a second sub-field in which all cells have the same luminances, again. In this instance, through the luminances of the discharge cells in the first sub-field are the same and the luminances of the discharge cells in the second sub-field are the same, the luminances of the first, and second sub-fields are not the same. In the sub-fields each formed by the one bit of video signal, there is a most significant sub-field by a most significant bit that has the highest luminance, a least significant sub-field by a least significant bit that has the lowest luminance, and a number of sub-fields by intermediate bits between the most significant bit and the least significant bit. For example, one frame of image with 8 bits of gradation is composed of an overlap of a first sub-field by the most significant bit, an eighth sub-field by the least significant bit, and a second, a third, a fourth, a fifth, and a sixth sub-fields of which luminances are differentiated by the six intermediate bits. In the sub-field method, such eight sub-fields are overlapped, to form one frame of perfect image by the residual image effect of a human eye.

FIG. 6 illustrates a four-division sub-field driving system in which the scan electrode driving unit has four divisions, and FIG. 7 illustrates scan pulses, sustain pulses, and data pulse in the selective erasure method in driving the four-division plasma display panel illustrated in FIG. 6.

Referring to FIG. 6, in a first address discharge interval in the four-division sub-field driving system, a first scan pulse 'a' illustrated in FIG. 7 is applied to a first scan electrode line S1, a second scan pulse 'b' is applied to an 121st scan electrode line S121, a third scan pulse 'c' is applied to a 241st scan electrode line S241, and a fourth scan pulse 'd' is applied to a 361st scan electrode line S361, for addressing the discharge cells on each of the lines. Then, in a second address discharge interval, the first scan pulse 'a' is applied to a second scan electrode line S2, a second scan pulse 'b' is applied to an 122nd scan electrode line S122, a third scan pulse 'c' is applied to a 242nd scan electrode line S242, and a fourth scan pulse 'd' is applied to a 362nd scan electrode line S362, for addressing the discharge cells on each of the lines. Thus, the four-division sub-field driving system illustrated in FIG. 6 proceeds the addressing until an $120^{th}$ addressing discharge interval is finished, to address the discharge cells on all the scan electrode lines S1, S2, . . . , S480. A sequence of providing the scan pulses in the four-division sub-field driving system illustrated in FIG. 6, i.e., an addressing sequence is as shown in Table 1, below.

TABLE 1

| scan pulse | 1st interval | 2nd interval | 3rd interval | — | 120th interval |
|---|---|---|---|---|---|
| 1st scan pulse 'a' | 1st | 2nd | 3rd | — | 120th |
| 2nd scan pulse 'b' | 121st | 122nd | 123rd | — | 240th |
| 3rd scan pulse 'c' | 231st | 232nd | 233rd | — | 360th |
| 4th scan pulse 'd' | 361st | 362nd | 363rd | — | 480th |

In this instance, as shown in FIG. 7, the address driving unit provides a data pulse which determines a discharge of the discharge cells connected to the scan electrode line to which a scan pulse is applied every time the scan pulse is applied in each address discharge interval. In the first address discharge interval, when the first scan pulse is applied to the first scan electrode line S1, the address driving unit applies a data pulse which determines a discharge of the discharge cells connected to the first scan electrode line S1. Then, when the second scan pulse is applied to the 121st scan electrode line S121, the address driving unit applies a data pulse which determines a discharge of the discharge cells connected to the 121st scan electrode line S121. Eventually, the address driving unit applies a data pulse of the video data for the discharge cells connected to the first scan electrode line to the address electrode lines, a data pulse of the video data for the discharge cells connected to the 121st scan electrode line to the address electrode lines, a data pulse of the video data for the discharge cells connected to the 241st scan electrode line to the address electrode lines, a data pulse of the video data for the discharge cells connected to the 361st scan electrode line to the address electrode lines, a data pulse of the video data for the discharge cells connected to the second scan electrode line to the address electrode lines, a data pulse of the video data for the discharge cells connected to the 122nd scan electrode line to the address electrode lines, a data pulse of the video data for the discharge cells connected to the 242nd scan electrode line to the address electrode lines, and a data pulse of the video data for the discharge cells connected to the 362nd scan electrode line to the address electrode lines. In the four-division sub-field system, upon completion of the first scan pulse application to the 120th scan electrode line S120 for forming a sub-field image of the most significant bit(MSB), the first scan pulse 'a' is applied to the first scan pulse electrode line S1 for forming a sub-field image of the next bit, and so on in the sequence as shown in Table 1. The four-division sub-field driving system forms an image on the plasma display by applying the scan pulses to the scan electrode lines as shown in Table 1.

However, the four-division sub-field driving system shown in FIG. 6 has the following problems.

The four-division sub-field driving system shows flickers of image at an interface portion L1 of a region P1 in which the scan electrode line is addressed by the first scan pulse and a region P2 in which the scan electrode line is addressed by the second scan pulse, at an interface portion L2 of a region P2 in which the scan electrode line is addressed by the second scan pulse and a region P3 in which the scan electrode line is addressed by the third scan pulse, and at an interface portion L3 of a region P3 in which the scan electrode line is addressed by the third scan pulse and a region P4 in which the scan electrode line is addressed by the four scan pulse. The flickers occur because the discharge cells connected to the scan electrode line at each interface portion may have bits of grades different from each other, with different discharge states. For example, while the discharge cells connected to the 120$^{th}$ scan electrode line S120 form an image of 7 bit grade, the discharge cells connected to the 121$^{st}$ scan electrode line S121 may form an image of 6 bit grade.

And, an image of the plasma display panel driven by the plasma display panel driving method illustrated in FIG. 6 generates contour noises, failing to provide a stable image to users. The contour noise is a disturbance of image a watcher can notice when the watcher watches the image while the watcher moves a point of view. This contour noise occurs frequently in a moving picture with a gradation. The contour noise occurs because the watcher happens to feel as if an image grade is formed irregularly at observing different sub-fields in one frame during the watcher watches the image while the watcher moves a point of view. For example, if the watcher watches an image formed on a lower portion of the screen momentarily, while the watcher watches an image formed on an upper portion of the screen, the watcher may sense a sub-field image totally different from the sub-field image formed on the upper portion. As a result, though the plasma display panel forms images smoothly, the watcher observes flickering of the image.

SUMMARY OF THE INVENTION

Accordingly, the present invention is directed to circuit and method for driving a plasma display panel that substantially obviates one or more of the problems due to limitations and disadvantages of the related art.

An object of the present invention is to provide a circuit and method for driving a plasma display panel which can reduce flickers and contour noises which occur in a plasma display panel image, to form a stable image.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for diving a plasma display panel includes the step of scanning a plurality of driving regions which are divisions of the plasma display panel on the same time.

In other aspect of the present invention, there is provided a method for driving a plasma display panel including the steps of (1) applying first scan pulses to a first driving block, which is any one of the driving blocks, in every given driving cycle starting from a first scan electrode line to (n)th scan electrode line in succession, and (2) applying second scan pulses each having a given application time difference from the application time of the first scan pulse to a second driving block adjacent to the first driving block starting from (m)th scan line to a first scan line in a reverse sequence to the first scan pulses. In this instance, the second scan pulse is applied to a scan electrode line in the first driving block and the first scan pulse is applied to a scan electrode line in the second driving block in every given cycle. That is, an application sequence of the scan pulses applied to the first driving block and the second driving block is changed in turn in every given cycle.

In another aspect of the present invention, there is provided circuit for driving a plasma display panel including a panel unit having a plurality of scan electrode line and a plurality of sustain electrode lines, both arranged in parallel to each other, a plurality of address electrode lines arrange to cross the scan electrode line, with a discharge cell formed at every cross of the scan electrode lines and the address electrode lines, a plurality of driving circuit for applying driving signals different from one another to groups of scan electrode lines of a given number, a common circuit unit for applying driving signals to the sustain electrode lines, and a control unit for applying control signals to different driving units.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

The plasma display panel to which a method for driving a plasma display panel of the present invention is applied has a plurality of driving blocks. In one embodiment of the present invention, a first scan pulse is applied to scan electrode lines in a first driving block which may be any one of the plurality of driving blocks in succession starting from a first scan line to a last scan line, and, within the same sustain pulse cycle, a second scan pulse is applied to scan electrode lines in a second driving block adjacent to the first driving block starting from a last scan line to a first scan line in succession such that an application of the second scan pulse has a given time difference from an application of the first scan pulse. The first, and second scan pulses have different application time points within identical sustain pulses. In the present invention, the scan pulses are applied to a driving block not at fixed time points within sustain pulses, but at time points varied with given cycles. There can be various embodiments of the present invention depending on application cycles and sequences of the different scan pulses to each driving block.

Reference will now be made in detail to the preferred embodiments of the present invention, examples of which are illustrated in the accompanying drawings.

First Embodiment

Figure 1:
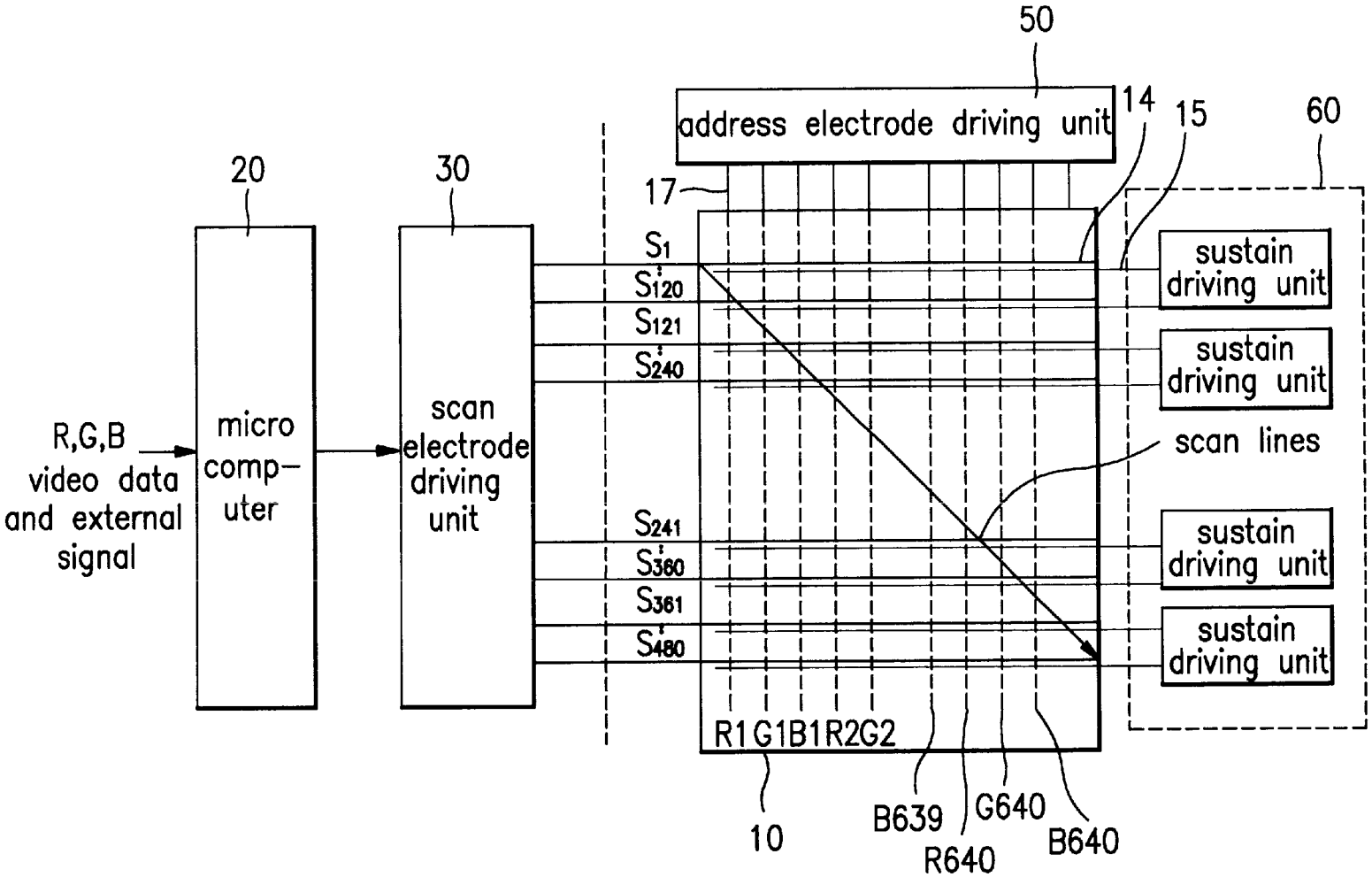
FIG. 1 illustrates a system of a related art plasma display panel with a resolution of 640×480.
Figure 2A:
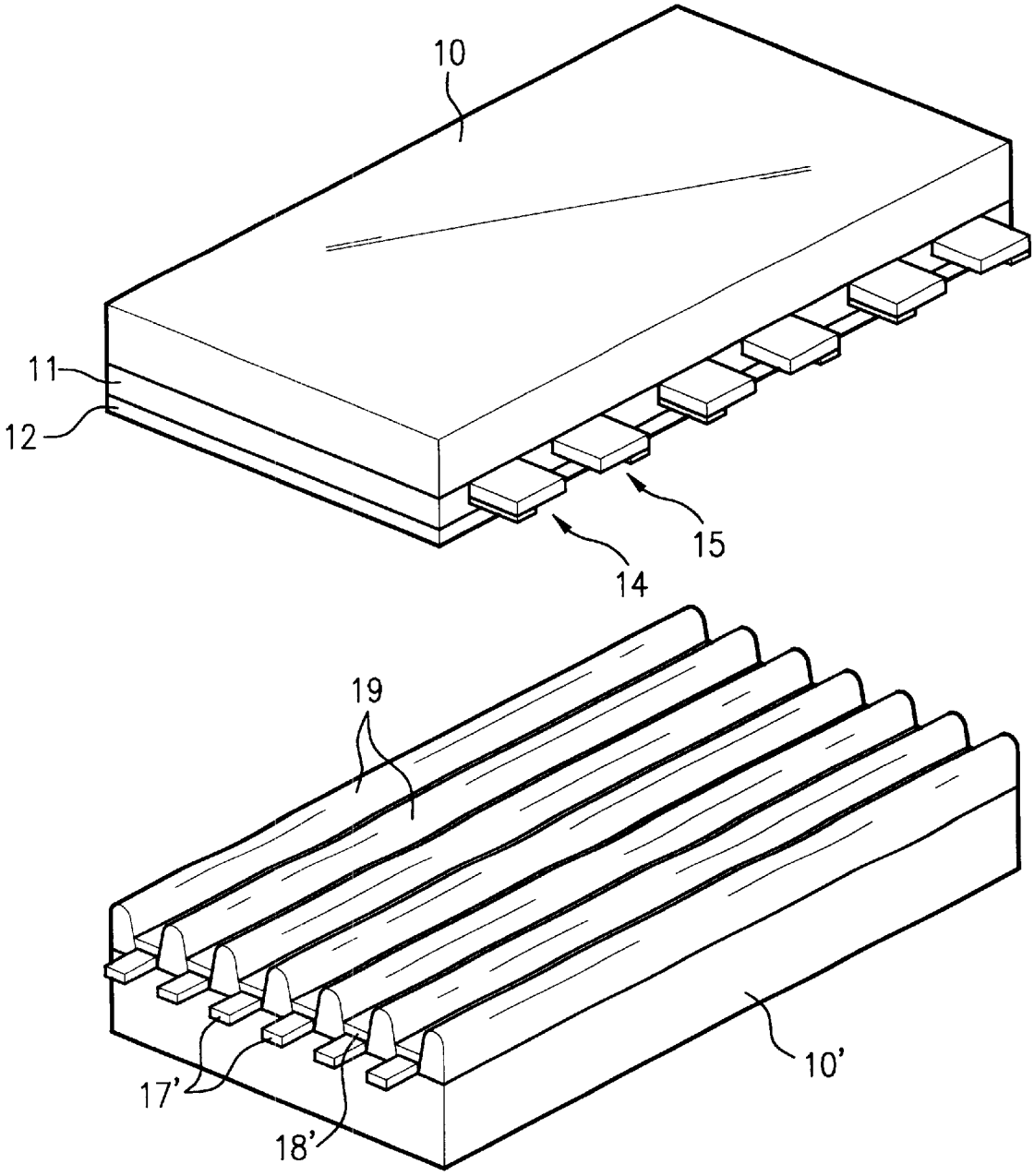
FIG. 2*a* illustrates a perspective view of an upper substrate and a lower substrate fitted facing each other in a plasma display panel.
Figure 2B:
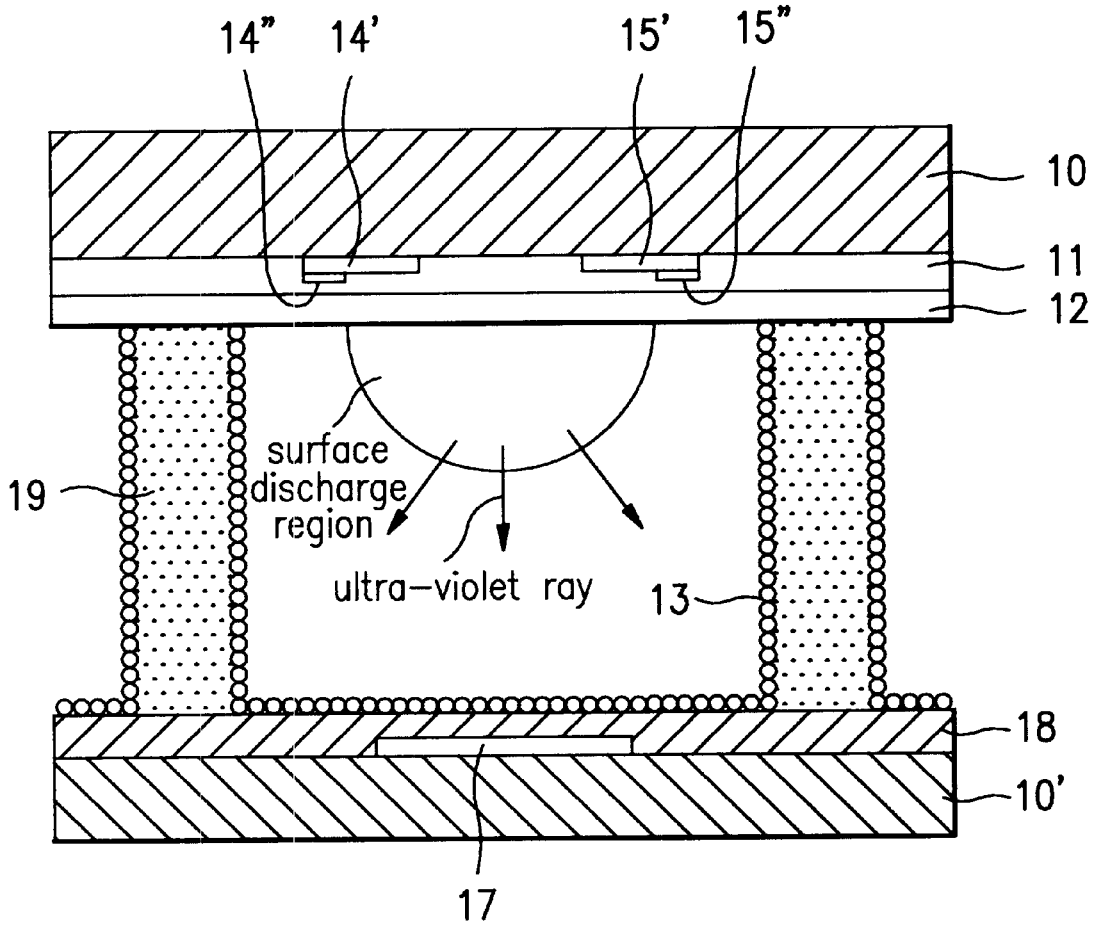
FIG. 2*b* illustrates a section of the panel illustrated in FIG. 2*a;*
Figure 3:
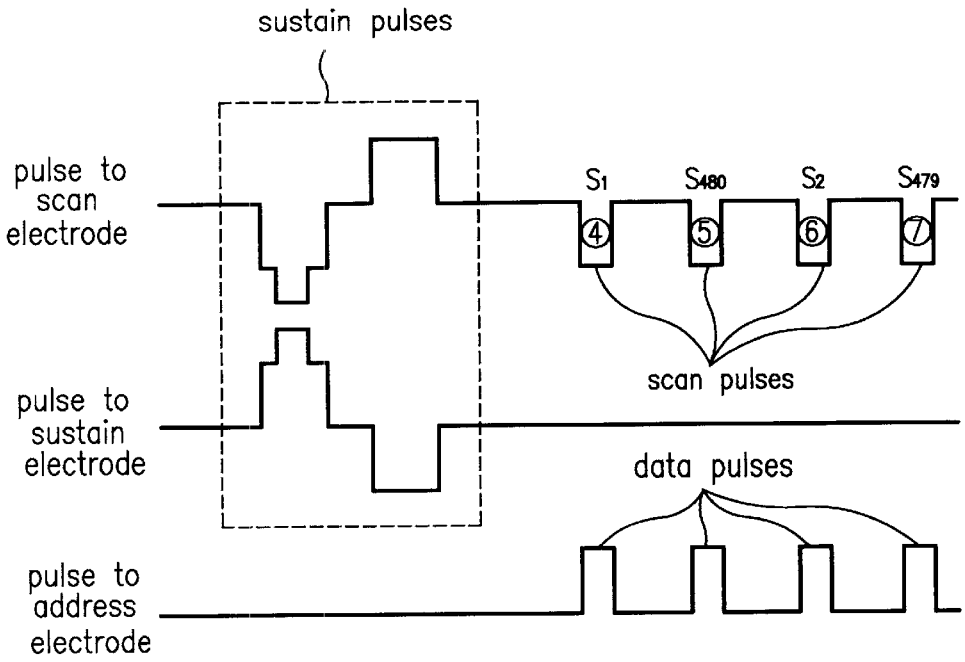
FIG. 3 illustrates a diagram of waveforms of driving pulses for driving a related art plasma display panel.
Figure 4:
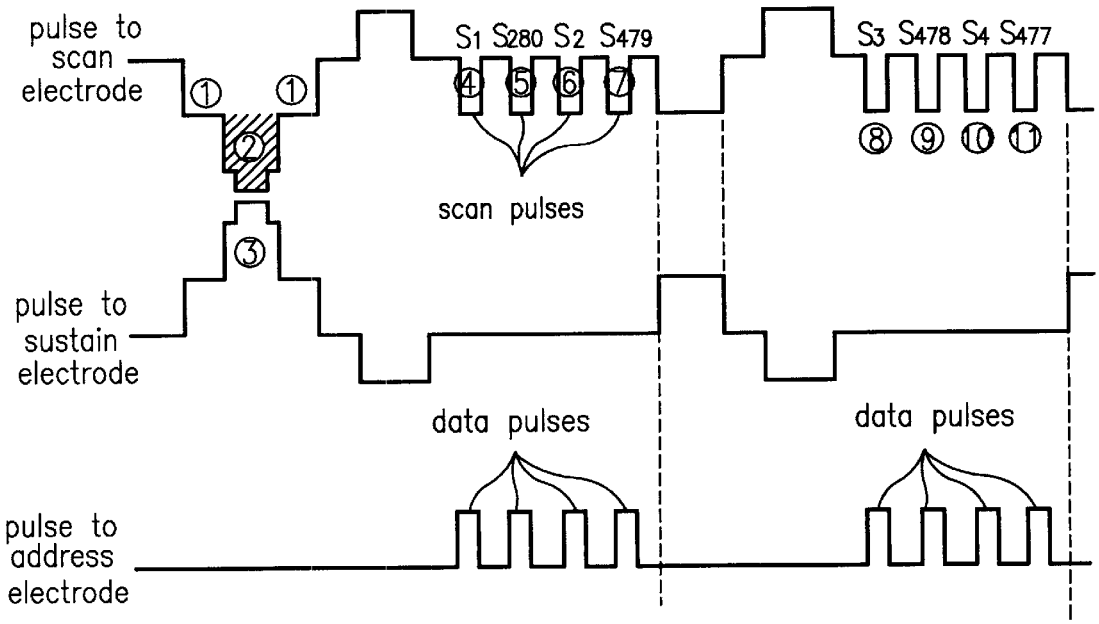
FIG. 4 illustrates a diagram of waveforms of pulses applied to respective electrodes in a related art plasma display panel according to a selective erasure method.
Figure 5:
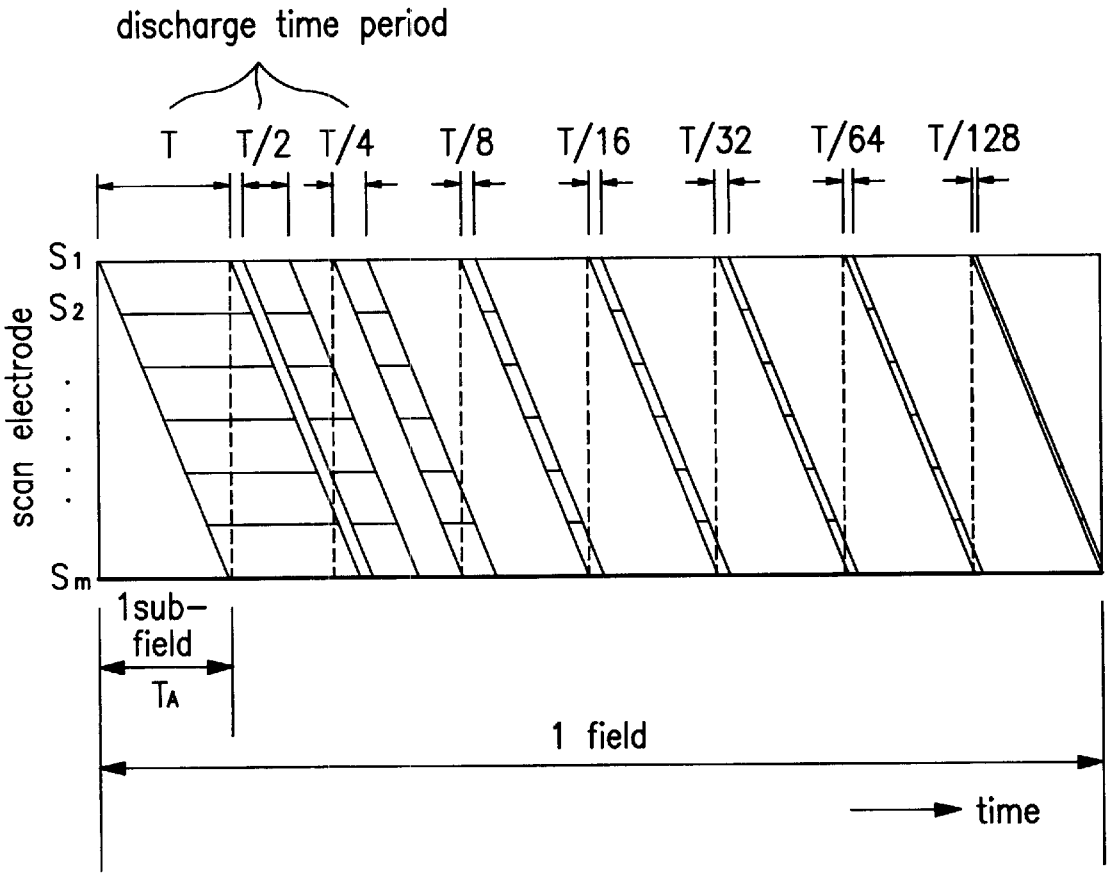
FIG. 5 illustrates a diagram showing a related art method for driving a plasma display panel in a sub-field system.
Figure 6:
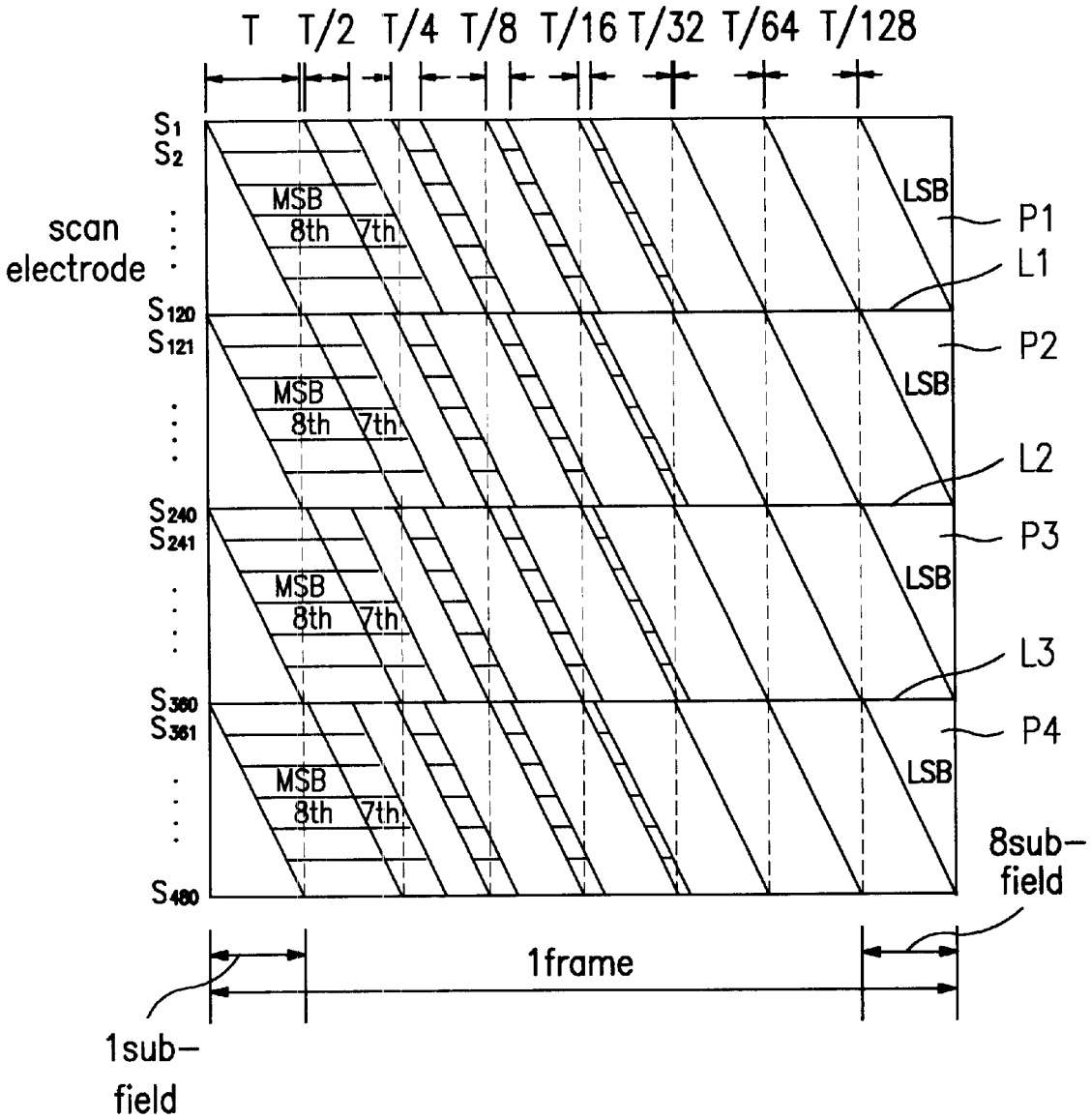
FIG. 6 illustrates a diagram showing a related art method for driving a plasma display panel in a four-division sub-field system.
Figure 7:
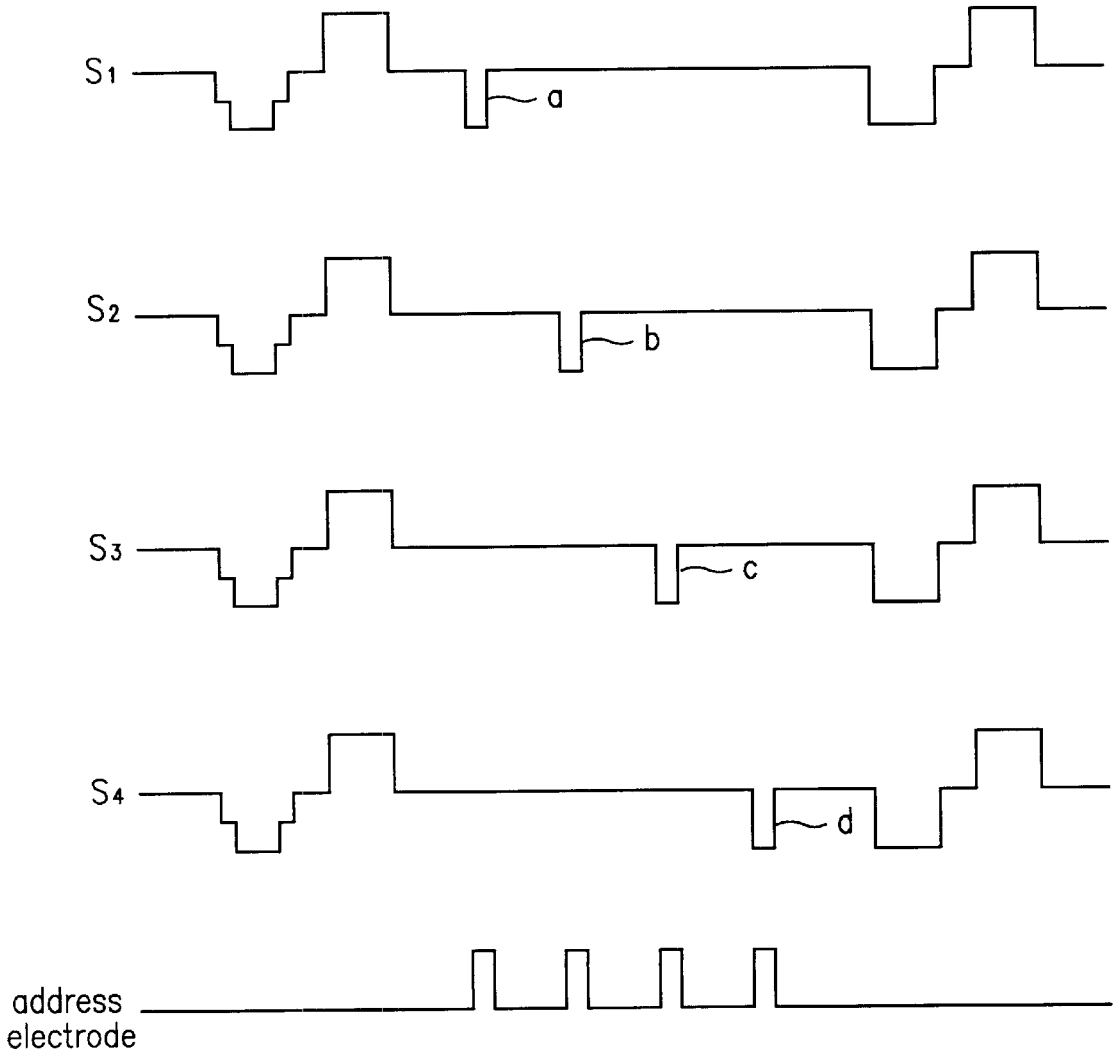
FIG. 7 illustrates a waveform diagram showing scan pulses, sustain pulses, and data pulse for driving the four-division plasma display panel illustrated in FIG. 6.
Figure 8A:
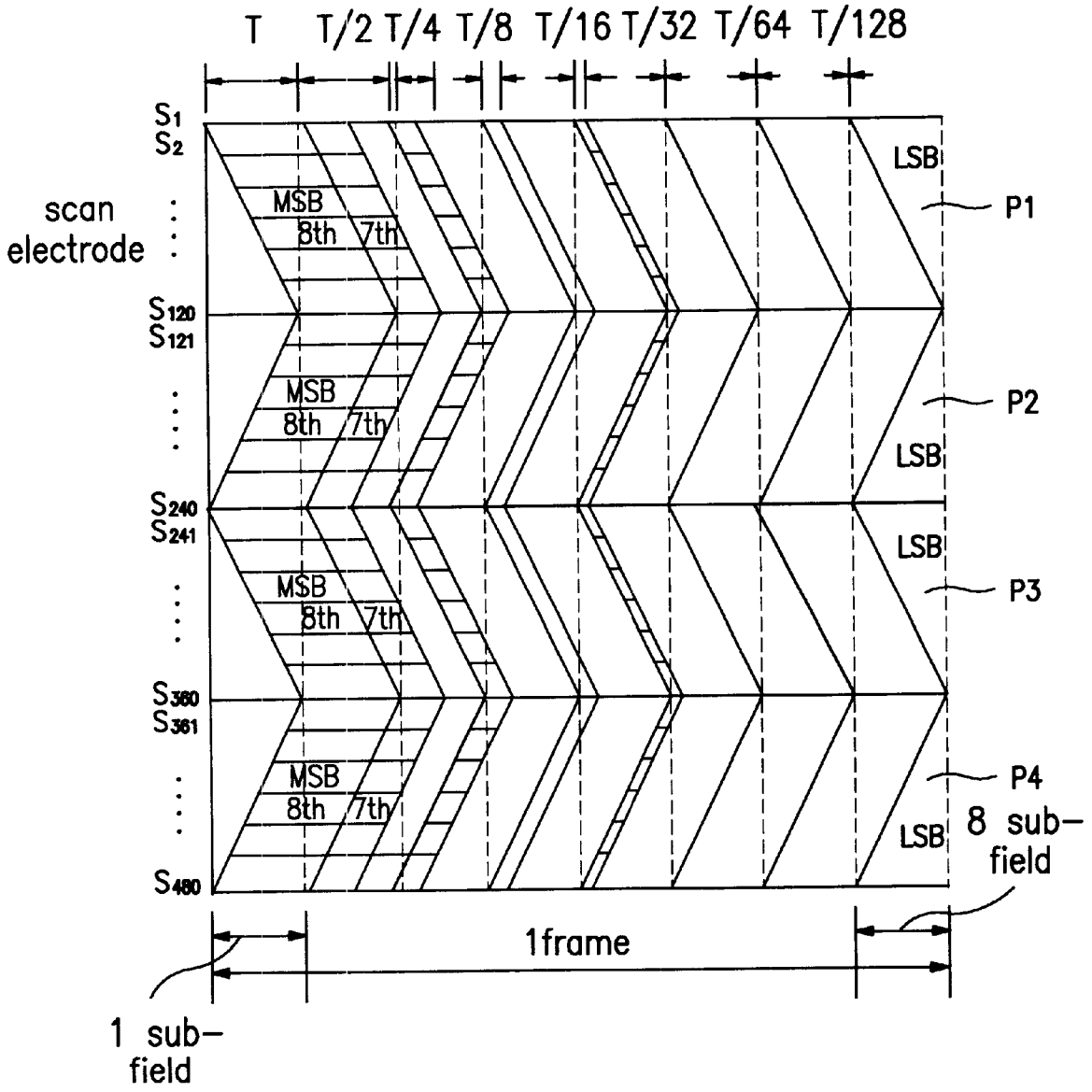
FIG. 8*a* illustrates a diagram showing a method for driving a plasma display panel in accordance with a preferred embodiment of the present invention.
Figure 8B:
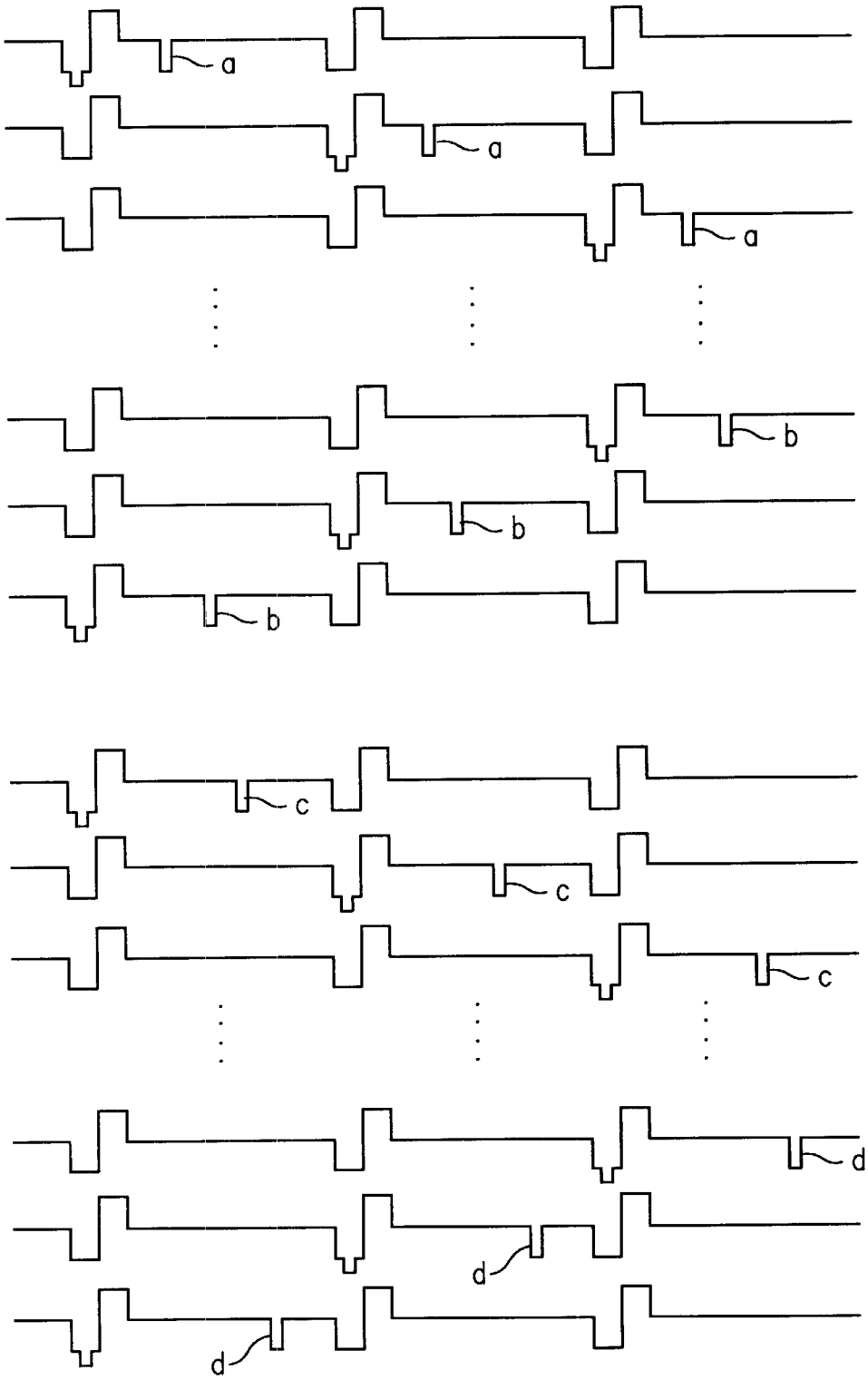
FIG. 8*b* illustrates a waveform diagram showing scan applied to the plasma display panel illustrated in FIG. 8*a;*
Figure 9:
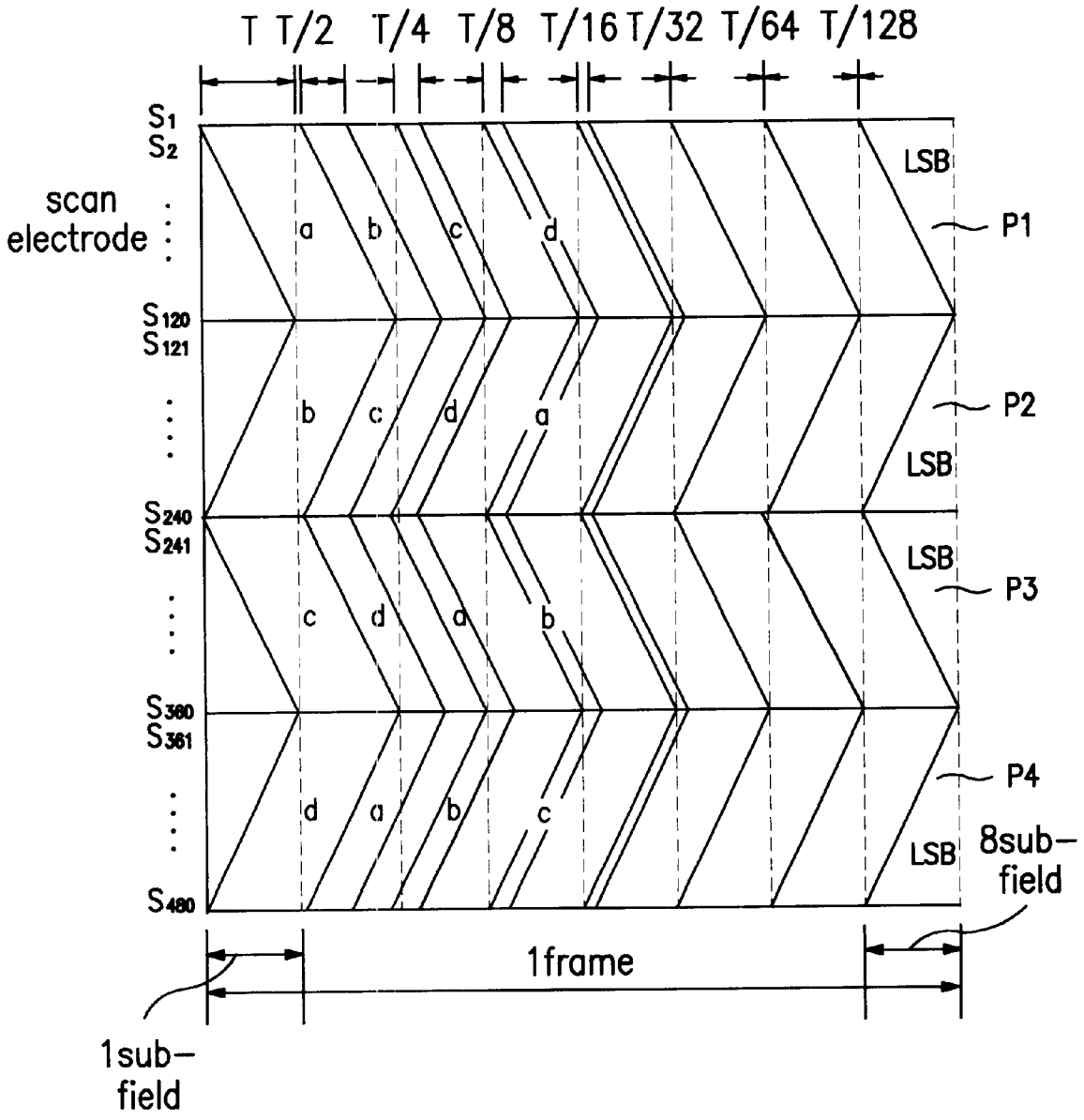
FIG. 9 illustrates a diagram showing a method for driving a plasma display panel in accordance with a first preferred embodiment of the present invention.

Referring to FIG. 9, in the first embodiment of the present invention, an application time point of the scan pulse to each driving block is changed in a sequence whenever a sub-field is changed. That is, provided that the first scan pulse 'a' is applied to the first driving block P1 and, within the same sustain pulse cycle, a second scan pulse 'b' is applied to the second driving block P2 firstly, to form an (n)th sub-field image, in turn, the second scan pulse 'b' is applied to the first driving block P1 and, within the same sustain pulse cycle, the first scan pulse 'a' is applied to the second driving block P2 secondly, to form a (n+1)th sub-field image. Then, again, the first scan pulse 'a' is applied to the first driving block P1 and the second scan pulse 'b' is applied to the second driving block within the same sustain pulse cycle, to form an (n+2)th sub-field image. If there are three or more driving blocks in the first embodiment of the present invention, the application time points of the scan pulses applied to different driving blocks respectively are changed in a sequence whenever the sub-field is changed. That is, if the first scan pulse is applied to the first driving block, the second pulse to the second driving block, and the third scan pulse to the third driving block, all within the same sustain pulse cycle firstly, to form an (n)th sub-field image, the first scan pulse is applied to the second driving block, the second scan pulse to the third driving block, and the third scan pulse to the first driving block, all within the same sustain pulse cycle secondly, to form an (n+1)st sub-field image. Then, the first scan pulse is applied to the third driving block, the second scan pulse to the first driving block, and the third scan pulse to the second driving block, all within the same sustain pulse cycle thirdly, to form an (n+2)nd sub-field image. As shown in FIG. 9, when there are four driving blocks in the first embodiment plasma display panel of the present invention, if the first scan pulse is applied to the first driving block, the second pulse to the second driving block, the third scan pulse to the third driving block, and the fourth scan pulse to the fourth driving block, all within the same sustain pulse cycle, to form an (n)th sub-field image firstly, the first scan pulse is applied to the second driving block, the second pulse to the third driving block, the third scan pulse to the fourth driving block, and the fourth scan pulse to the first driving block, all within the same sustain pulse cycle, to form an (n+1)st sub-field image secondly, the first scan pulse is applied to the third driving block, the second pulse to the fourth driving block, the third scan pulse to the first driving block, and the fourth scan pulse to the second driving block, all within the same sustain pulse cycle, to form an (n+2)nd sub-field image thirdly, and the first scan pulse is applied to the fourth driving block, the second pulse to the first driving block, the third scan pulse to the second driving block, and the fourth scan pulse to the third driving block, all within the same sustain pulse cycle, to form an (n+3)rd sub-field image fourthly and finally. The driving blocks in the first embodiment plasma display panel of the present invention preferably has the same number of scan electrode lines. In the first embodiment driving method of the present invention, though it is preferable that an application time point of the scan pulse to each driving block is changed in a sequence whenever a sub-field is changed, an application of the first embodiment method of the present invention may be extended such that the application time point of the scan pulse is changed in sequence whenever one set of sub-fields are changed instead of one sub-field.

Second Embodiment

Figure 10:
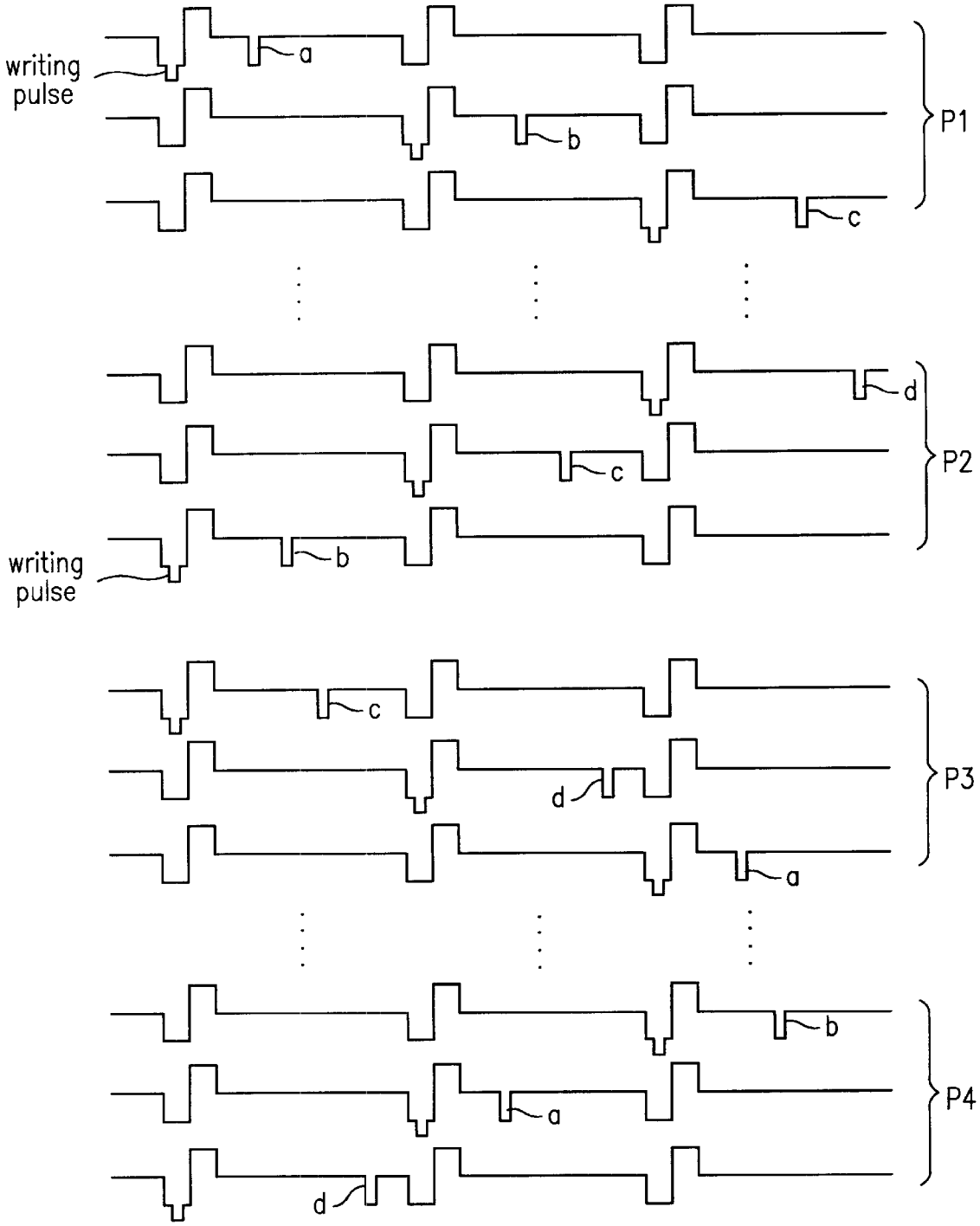
FIG. 10 illustrates a diagram showing a method for driving a plasma display panel in accordance with a second preferred embodiment of the present invention.

Referring to FIG. 10, in a second embodiment method of the present invention, an application time point of the scan pulse applied to each driving block is changed in a sequence for every cycle of the sustain pulse. That is, provided that the first scan pulse is applied to the first driving block and, within the same sustain pulse cycle, a second scan pulse is applied to the second driving block to form an (n)th sub-field image in a first cycle of the sustain pulse, the second scan pulse is applied to the first driving block and, within the same sustain pulse cycle, the first scan pulse is applied to the second driving block to form an (n+1)th sub-field image in a second cycle of the sustain pulse. Then, again, the first scan pulse is applied to the first driving block and the second scan pulse is applied to the second driving block within the same sustain pulse cycle, to form an (n+2)th sub-field image in a third cycle of the sustain pulse. If there are three or more driving blocks in the second embodiment of the present invention, the application time points of the scan pulses applied to different driving blocks respectively are changed in a sequence in every sustain pulse cycle. That is, if the first scan pulse is applied to the first driving block, the second pulse to the second driving block, and the third scan pulse to the third driving block, all within the same sustain pulse cycle to form an (n)th sub-field image in the first cycle of the sustain pulse, the first scan pulse is applied to the second driving block, the second scan pulse to the third driving block, and the third scan pulse to the first driving block, all within the same sustain pulse cycle, to form an (n+1)st sub-field image in the second cycle of the sustain pulse. Then, the first scan pulse is applied to the third driving block, the second scan pulse to the first driving block, and the third scan pulse to the second driving block, all within the same sustain pulse cycle, to form an (n+2)nd sub-field image in the third cycle of the sustain pulse. As shown in FIG. 10, when there are four driving blocks in the first embodiment plasma display panel of the present invention, if the first scan pulse is applied to the first driving block, the second pulse to the second driving block, the third scan pulse to the third driving block, and the fourth scan pulse to the fourth driving block, all within the same sustain pulse cycle, to form an (n)th sub-field image in the first cycle of the sustain pulse, the first scan pulse is applied to the second driving block, the second pulse to the third driving block, the third scan pulse to the fourth driving block, and the fourth scan pulse to the first driving block, all within the same sustain pulse cycle, to form an (n+1)st sub-field image in the second cycle of the sustain pulse, the first scan pulse is applied to the third driving block, the second pulse to the fourth driving block, the third scan pulse to the first driving block, and the fourth scan pulse to the second driving block, all within the same sustain pulse cycle. to form an (n+2)nd sub-field image in the third cycle of the sustain pulse, and the first scan pulse is applied to the fourth driving block, the second pulse to the first driving block, the third scan pulse to the second driving block, and the fourth scan pulse to the third driving block, all within the same sustain pulse cycle, to form an (n+3)rd sub-field image in the fourth cycle of the sustain pulse and finally. The driving blocks in the first embodiment plasma display panel of the present invention preferably has the same number of scan electrode lines. In the second embodiment driving method of the present invention, though it is preferable that an application time point of the scan pulse to each driving block is changed in a sequence in every cycle of the sustain pulse, an application of the second embodiment method of the present invention may be extended such that the application time point of the scan pulse is changed in sequence in every set of cycles of the sustain pulses instead of every sustain pulse.

Third Embodiment

Figure 11:
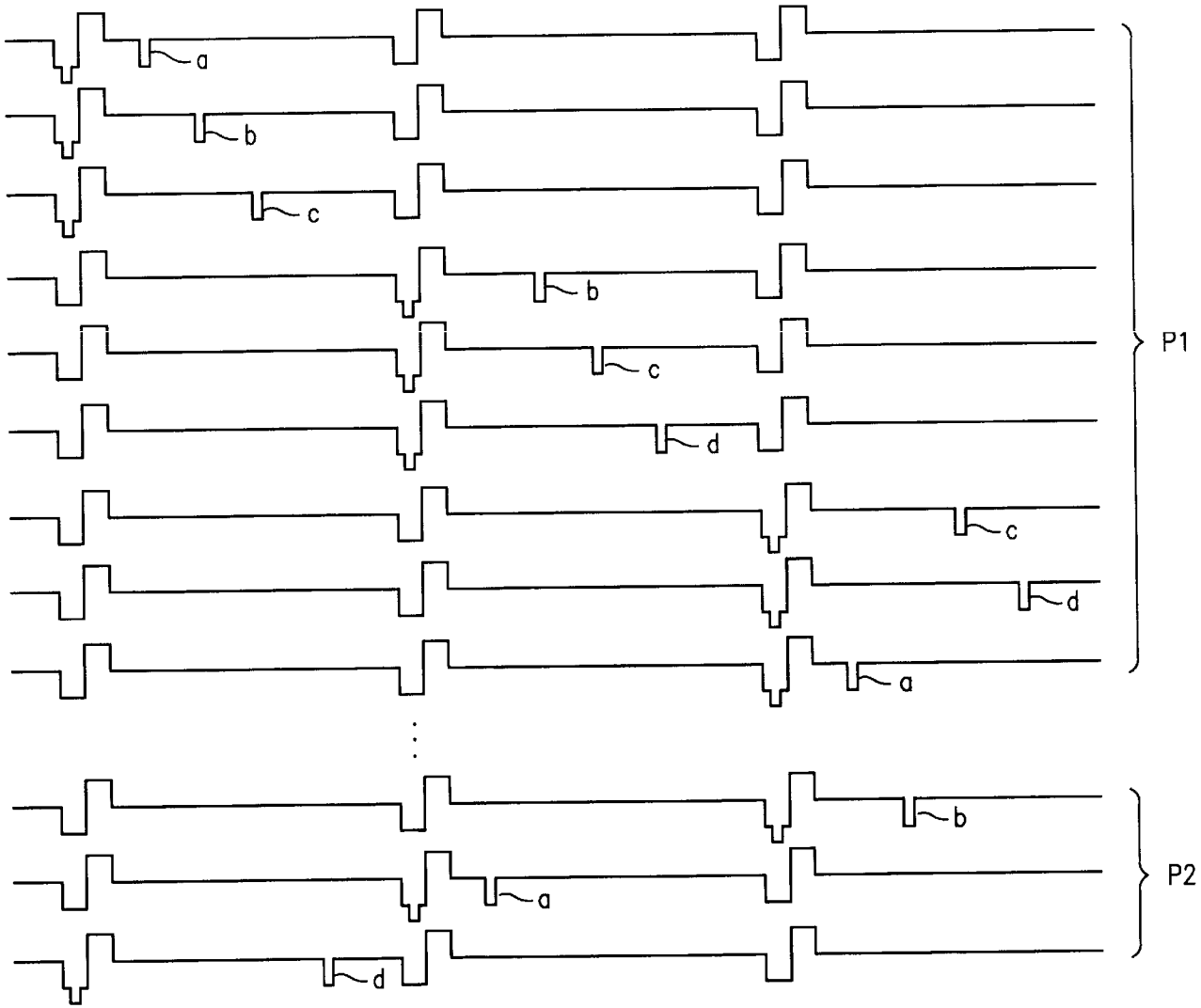
FIG. 11 illustrates a diagram showing a method for driving a plasma display panel in accordance with a third preferred embodiment of the present invention.

In the third embodiment of the present invention, the driving block has two, or more scan pulses applied thereto while a sequence of the application is changed in turn in every given driving cycle. If, within one cycle of the sustain pulse, the first scan pulse 'a' is applied to the first driving block P1 at an (x)th scan electrode line and the second scan pulse 'b' is applied to the second driving block P2 at a (y)th scan electrode line firstly, the third scan pulse 'c' is applied to the first driving block P1 a (x+1)st scan electrode line before the second scan pulse 'b' is applied to the second driving block P2 at a (y−1)st scan electrode line secondly. And, after the scan pulses are applied to all scan electrode lines in the first driving block P1, the third scan pulse 'c' is applied to the first driving block P1 at the (x)th scan electrode line having the first scan pulse 'a' applied thereto and the first scan pulse 'a' is applied to the first driving block at a (x+1)st scan electrode line. That is, to match total time periods of applying the scan pulses to all scan electrode lines in the first driving block P1 and the second driving block P2 respectively, within the same sustain pulse cycle, the first scan pulse 'a' is applied to the first driving block P1 at the (x)th scan electrode line, the second scan pulse 'b' is applied to the first driving block P1 at the (x+1)st scan electrode line, and the third scan pulse 'c' is applied to the second driving block P2 at the (y)th scan electrode line. Thus, in the third embodiment of the present invention, numbers of the scan electrode lines in the first and second driving blocks P1 and P2 should be at a ratio of 2:1. That is, within a given cycle, a ratio of numbers of the scan pulses applied to the first driving block P1 and the scan pulses applied to the second driving block is the same with the ratio of the numbers of the scan electrode lines in the first driving block P1 and the scan electrode lines in the second driving block P2. The ratio of the numbers of the scan electrode lines in the first and second driving blocks P1 and P2 may be greater than 3:1. As shown in FIG. 11, if the ratio of the numbers of the scan electrode lines in the first and second driving blocks P1 and P2 is 3:1, within the same sustain pulse cycle, the first, second, and third scan pulses 'a', 'b', and 'c' are applied to the first driving block P1 at an (x)th, (x+1)st, and (x+2)nd scan electrode lines respectively, during which cycle the fourth scan pulse 'd' is applied to the second driving block P2 at a (y)th scan electrode line. Then, a sequence of applications of the scan pulses to the driving blocks is changed in turn in every given driving cycle. For example, within a first sustain pulse cycle, if the first, second, and third scan pulses 'a', 'b', and 'c' are applied to the first driving block P1 at the (x)th, (x+1)st, and (x+2)nd scan electrode lines in succession respectively and the fourth scan pulse 'd' is applied to the second driving block P2 at the (y)th scan electrode line, to form an (n)th frame. Then, within the second sustain pulse cycle, the second, third, and fourth scan pulses 'b', 'c', and 'd' are applied to the first driving block P1 at the (x+3)rd, (x+4)th, and (x+5)th scan electrode lines in succession respectively and the first scan pulse 'a' is applied to the second driving block P2 at the (y−1)th scan electrode line, to form an (n+1)th frame. Then, within the third sustain pulse cycle, the third, fourth, and first scan pulses 'c', 'd', and 'a' are applied to the first driving block P1 at the (x+6)th, (x+7)th, and (x+8)th scan electrode lines in succession respectively and the second scan pulse 'b' is applied to the second driving block P2 at the (y−2)th scan electrode line, to form an (n+2)th frame. In this instance, the sequence of the scan pulse application may be changed in turn in either every frame as explained, or every set of frames instead of every frame, or every sub-field, or every set of sub-fields. Though it is preferable that the ratio of the numbers of the scan pulses applied to the first and second driving blocks P1 and P2 is an integer, the ratio may not be an integer. The sequence of the scan pulse application may be changed in turn in every integer time of the sustain pulse cycle. That is, if the first, second, and third scan pulses 'a', 'b', and 'c' are applied to the first driving block P1 at a first to third scan electrode lines respectively in succession and the fourth scan pulse 'd' is applied to the second driving block P2 at a first scan electrode line firstly, the fourth, first, and second scan pulses 'd', 'a', and 'b' are applied to the first driving block P1 at a fourth to sixth scan electrode lines in succession respectively and the third scan pulse 'c' is applied to the second driving block P2 at a second scan electrode line secondly. Then, the third, fourth, and first scan pulses 'c', 'd', and 'a' are applied to the first driving block P1 at a seventh to ninth scan electrode lines in succession respectively and the second scan pulse 'b' is applied to the second driving block P2 at a third scan electrode line thirdly and the second, third, and fourth scan pulses 'b', 'c', and 'd' are applied to the first driving block P1 at a tenth to twelfth scan electrode lines in succession respectively and the first scan pulse 'a' is applied to the second driving block P2 at a fourth scan electrode line fourthly.

Fourth Embodiment

In the fourth embodiment of the present invention, scan pulses for forming sub-fields different from each other are applied to one driving block with a given time difference.

Figure 12:
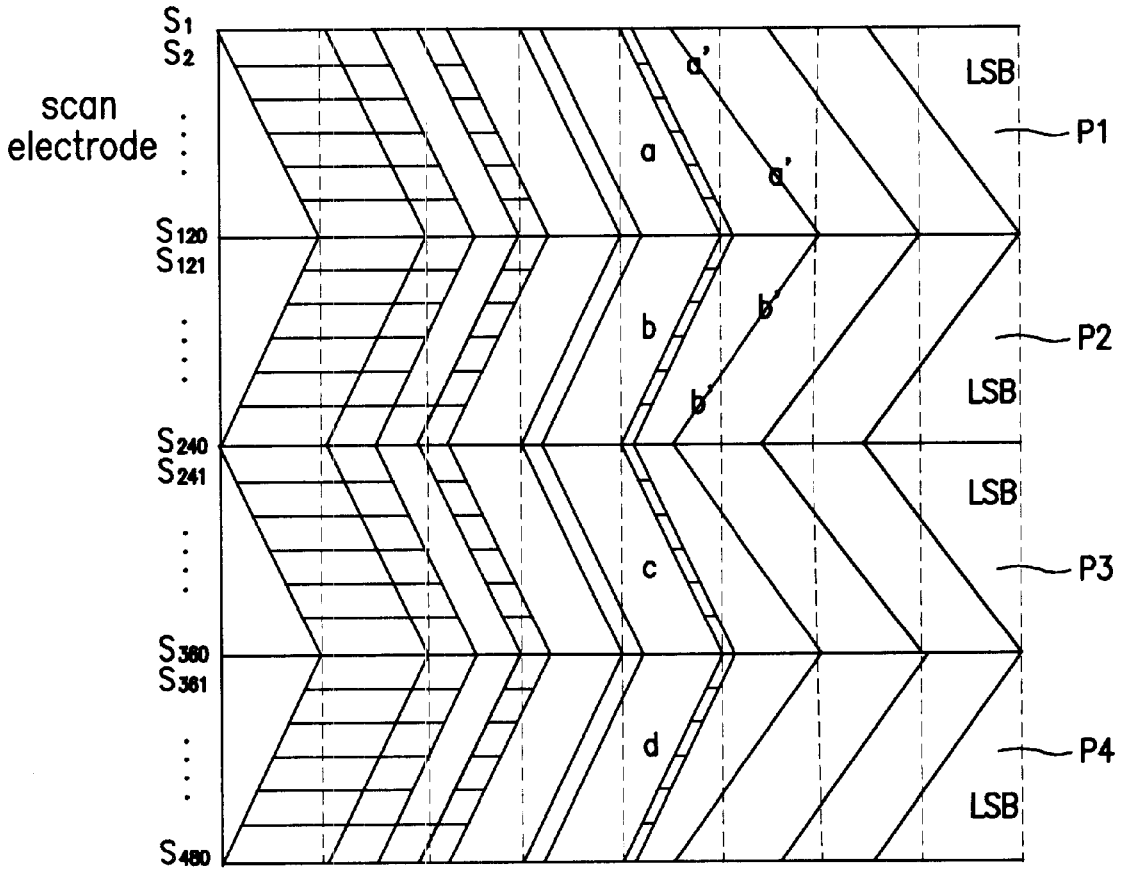
FIG. 12 illustrates a diagram showing a method for driving a plasma display panel in accordance with a fourth preferred embodiment of the present invention; and, FIG. 13 illustrates a circuit for driving a plasma display panel in accordance with a preferred embodiment of the present invention.

Referring to FIG. 12, in the fourth embodiment the first scan pulse 'a' for an (n)th sub-field image is applied to the first driving block P1 at an (x)th scan electrode line and the first scan pulse 'a" for an (n+1)st sub-field image is applied to the first driving block P1 at a first scan electrode line within the same sustain pulse cycle. And, the second scan pulse 'b' for an (n)th sub-field image is applied to the second driving block P2 at an (y)th scan electrode line and the first scan pulse 'b" for an (n+1)st sub-field image is applied to the second driving block P2 at a first scan electrode line within the same sustain pulse cycle. In this instance, within the same sustain pulse cycle, though the application time point of the first scan pulse 'a" is the same with the application time point of the first scan pulse 'a', a sub-field image formed by the first scan pulse 'a" is different from a sub-field image formed by first scan pulse 'a', and within the same sustain pulse cycle, the application time point of the second scan pulse 'b" is the same with the application time point of the second scan pulse 'b', a sub-field image formed by the second scan pulse 'b" is different from a sub-field image formed by second scan pulse 'b'.

Figure 13:
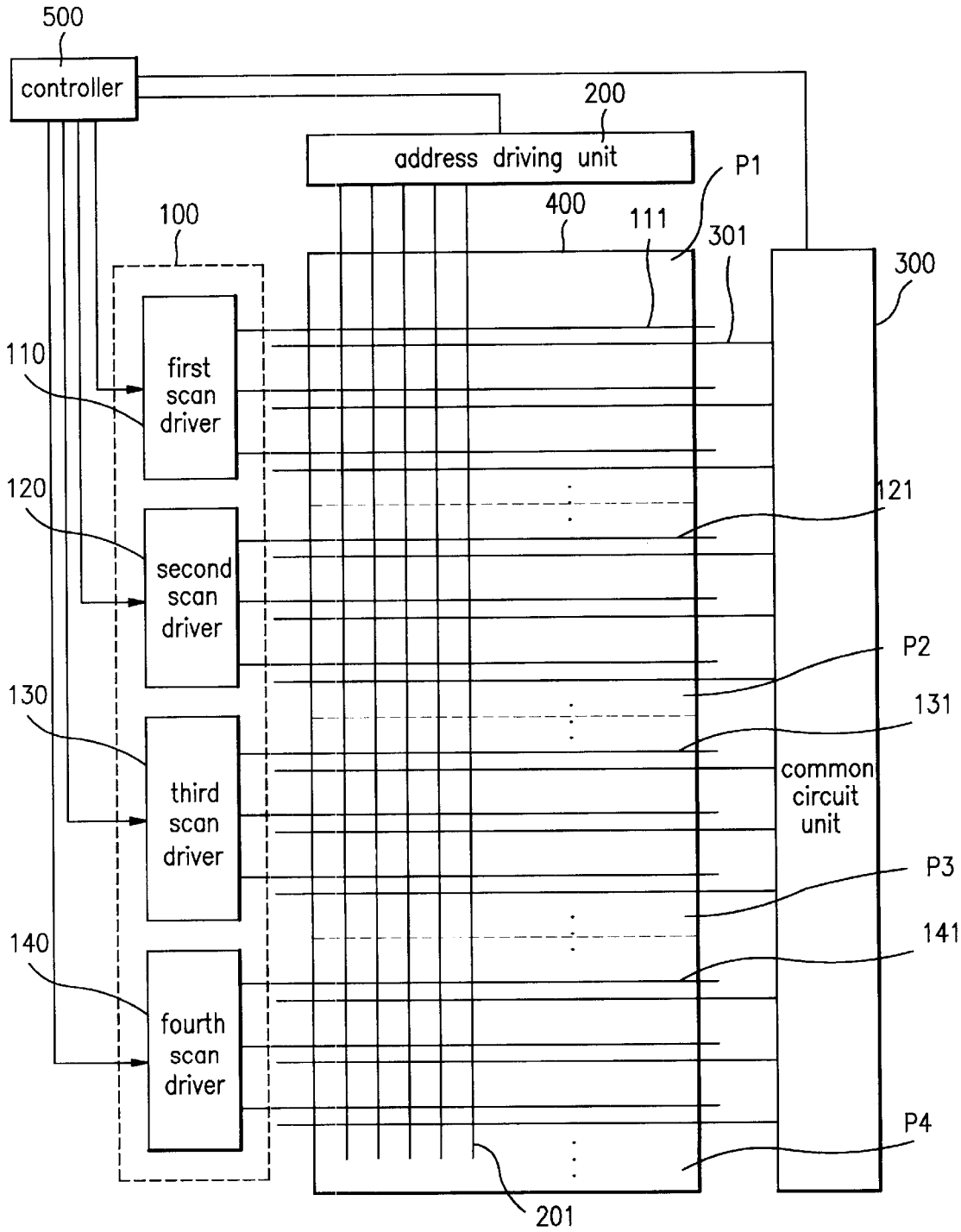

FIG. 13 illustrates a circuit for driving a plasma display panel in accordance with a preferred embodiment of the present invention.

Referring to FIG. 13, the circuit for driving a plasma display panel in accordance with a preferred embodiment of the present invention includes a panel unit 400 for displaying an image, a scan driving unit 100 for applying a sustain pulse and a scan pulse to the panel unit 400, a common circuit unit 300 for applying a sustain pulse having a phase opposite to the sustain pulse to the scan driving unit 100, an address driving unit 200 for applying a video data to the panel unit 400, and a controlling unit 500 for applying control signals to different units 100, 200 and 300. The panel unit 400 has a plurality of scan electrode lines 111, 121, 131 and 141 and a plurality of sustain electrode lines 301, both arranged in parallel, and address electrode lines 201 arranged to cross the scan electrode lines 111, 121, 131 and 141. There is a discharge cell at every cross of each of the scan electrode lines 111, 121, 131 and 141 and the address electrode lines 201. The panel unit 400 is operative in response to the scan pulse and the sustain pulse from the scan driving unit 100 and the sustain pulse from the common circuit unit 300. The scan driving unit 100 applies the scan pulses and the sustain pulses, both different from one another respectively, to blocks P1, P2, P3 and P4 of the scan electrode lines 111, 121, 131 and 141. That is, each of a first to a fourth scan drivers 110, 120, 130 and 140 applies scan pulses, such as first scan pulse 'a' and a second scan pulse 'b', to respective scan electrode lines 111, 121, 131 and 141. The common circuit unit 300 sustains applies a pulse to the sustain electrode lines to sustain discharge in the discharge cells between the scan electrode lines 111, 121, 131 and 141 and the sustain electrode lines 301. The control unit 500 latches scan data and applies control signals to respective scan drivers 110, 120, 130 and 140, to control application of the scan pulses to the scan electrode lines 111, 121, 131 and 141.

In all of the aforementioned embodiments of the present invention, a scan data for a (j+1)th second scan pulse 'b' to be applied to the second driving block P2 is adapted to be latched at the control unit during a time between application time points of a (j)th first scan pulse 'a' and a (j+1)th first scan pulse 'a' to the first driving block P1.

The method for driving a plasma display panel of the present invention has an advantage of preventing flicker because interfaces between driving blocks are continuous with respect to time. The method and the circuit for driving a PDP of embodiments of the present invention can provides a PDP having a resolution better than an HDTV because intervals of scan pulse application to adjacent lines are short.

It will be apparent to those skilled in the art that various modifications and variations can be made in the circuit and method for driving a plasma display panel of the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel having a plurality of driving blocks each with a plurality of scan electrode lines, comprising the steps of:

(1) applying a plurality of first scan pulses to a first driving block of the driving blocks by providing one per driving cycle starting from a first scan electrode line to a (n)th scan electrode line in succession; and (2) applying a plurality of second scan pulses to a second driving block by providing one per driving cycle starting from a (m)th scan line to a first scan line in a reverse sequence to the first scan pulses, wherein the first and second driving blocks apply the first and second scan pulses to the scan electrode lines in first and second address periods within an address discharge interval, and wherein the first and second scan pulses alternate the first and second address periods, respectively in successive address discharge intervals.

2. The method of claim 1, wherein the first scan pulse and the second scan pulse are alternately applied to the first and second address periods, respectively, in a prescribed cycle.

3. The method as claim 2, wherein the prescribed cycle is one of the driving cycle and a multiple of a frame in which one image of the plasma display panel is displayed.

4. The method of claim 2, wherein the prescribed cycle is one of a multiple of the driving cycles and a sub-field of a frame.

5. The method of claim 1, further comprising applying a plurality of third scan pulses to a third driving block by providing one per the driving cycle starting from a (k)th scan line to a first scan line, wherein the address discharge interval further comprises a third address period, and wherein the first, second and third scan pulses alternate the first, second and third address periods, respectively, in a prescribed sequence.

6. The method of claim 5, wherein the prescribed sequence of the first scan pulse, the second scan pulse and the third scan pulse is changed in turn in a prescribed cycle.

7. The method of claim 6, wherein the prescribed cycle is a multiple of the driving cycle.

8. The method of claim 5, further comprising applying a plurality of fourth scan pulses to a fourth driving block by providing one per the driving cycle starting from a (l)th scan line to a first scan line, wherein the address discharge interval comprises a fourth address period, and wherein the first, second, third and fourth scan pulses alternate the first, second, third and fourth address periods, respectively, in the prescribed sequence.

9. The method of claim 8, wherein the prescribed sequence of the first scan pulses, the second scan pulses, the third scan pulses and the fourth scan pulses to the address periods is changed in turn in a prescribed cycle.

10. The method of claim 9, wherein the prescribed cycle a multiple of the driving cycle.

11. The method of claim 1, wherein a period of the driving cycle is approximately equal to two or more cycles of a sustain pulse applied to the plasma display panel.

12. The method of claim 1, wherein a period of the driving cycle is approximately equal to one cycle of a sustain pulse applied to the plasma display panel.

13. The method of claim 1, wherein (n) equals (m).

14. The method of claim 1, wherein the address discharge interval further comprises a third address period, wherein at least one additional first scan pulse is applied to a scan electrode line other than the adjacent scan electrode line in the first driving block having the first scan pulse applied thereto in the driving cycle, wherein the at least one additional first scan pulse is initially applied in the third address period.

15. The method of claim 1, wherein at least one additional second scan pulse is applied to a scan electrode line next to a scan electrode line in the second driving block having the second scan pulse applied thereto in the driving cycle, wherein the at least one additional second scan pulse is initially applied in the third address period.

16. The method of claim 1, wherein the address discharge interval includes four address periods, and wherein three scan pulses are applied to the first driving block among the plurality of driving blocks while the first and second scan pulses alternate the first through fourth address periods in a prescribed sequence.

17. The method of claim 1, wherein, within one driving cycle, a ratio of numbers of the first scan pulses and the second scan pulses is the same as a ratio of numbers of the scan electrode lines in the first driving block and the scan electrode lines in the second driving block.

18. The method of claim 1, wherein a first scan pulse for a (y+1)th sub-field is applied to the first scan electrode line in the first driving block before a first scan pulse for a (y)th sub-field is applied to the (n)th scan electrode line in the first driving block.

19. The method of claim 1, wherein a second scan pulse for a (y+1)th sub-field is applied to the (m)th scan electrode line in the second driving block before a second scan pulse for a (y)th sub-field is applied to the first scan electrode line in the second driving block in a single driving cycle.

20. The method of claim 1, wherein a scan data for a (j+1)th second scan pulse is latched during a time between application time points of a (j)th first scan pulse and a (j+1)th first scan pulse.

21. A circuit for driving a plasma display panel comprising:

a panel unit having a plurality of scan electrode lines and a plurality of sustain electrode lines, both arranged in parallel to each other, a plurality of address electrode lines arranged to cross the scan electrode lines, with a discharge cell formed at crossings of the scan electrode lines and the address electrode lines;

a plurality of driving circuits each to apply scan pulse signals to corresponding groups of scan electrode lines of said panel unit;

a common circuit unit to apply driving signals to the sustain electrode lines; and, a control unit to apply control signals to said common circuit and said plurality of driving circuits, wherein a prescribed number of scan pulses are applied to the scan electrode lines for each sustain pulse, wherein the control circuit provides the prescribed number of address periods corresponding to said scan pulse signals within each driving cycle, and wherein a sequence of driving circuits to said address periods changes for said each driving cycle.

22. The circuit of claim 21, wherein the common circuit unit includes the same number of groups as the plurality of driving circuits, and wherein a sequence of driving circuits to address periods changes for successive sustain pulses.

23. The circuit of claim 21, wherein the sequence of driving circuits to said address periods changes for one of a multiple of the driving cycle and a sub-field of a frame.

24. The circuit of claim 21, wherein the plurality of driving circuits total the prescribed number, wherein each of the driving circuits apply a scan pulse to one scan electrode line of the corresponding group of scan electrode lines for said each driving cycle, and wherein the prescribed number is four.

25. The circuit of claim 21, wherein first and second driving circuits of the plurality of driving circuits respectively apply first and second scan pulses to corresponding groups of the scan electrode lines in first and second address periods within an address discharge interval, and wherein the first and second scan pulses alternate the first and second address periods, respectively, in successive address discharge intervals.

26. The circuit of claim 21, wherein said each driving cycle corresponds to three address periods, wherein at least one additional first scan pulse is applied to a scan electrode line other than a scan electrode line corresponding to a first driving block having the first scan pulse applied thereto by the first driving block in the driving cycle, wherein the at least one additional first scan pulse is initially applied in the third address period.

27. The circuit of claim 21, wherein, within one driving cycle, a ratio of numbers of the first scan pulses and the second scan pulses is the same as a ratio of numbers of the scan electrode lines driven by a first driving circuit and the scan electrode lines driven by a second driving circuit of the plurality of driving blocks.

28. The circuit of claim 21, wherein a first driving circuit of the driving circuits applies a plurality of first scan pulses by providing one per driving cycle starting from a first scan electrode line to a (n)th scan electrode line of a corresponding group in succession, and wherein a second driving circuit of the driving circuits applies a plurality of second scan pulses by providing one per driving cycle starting from a (m)th scan electrode line to a first scan electrode line of a corresponding group in a reverse sequence to the first scan pulses.

29. The circuit of claim 28, wherein a second scan pulse for a (y+1)th sub-field is applied to the (m)th scan electrode line in the second driving circuit before a second scan pulse for a (y)th sub-field is applied to the first scan electrode line in the second driving circuit in a single driving cycle.

30. The method of claim 1, wherein the first driving block is any of the plurality of driving blocks.

31. A method for driving a plasma display panel having a plurality of driving blocks each with a plurality of scan electrode lines, comprising:

applying a prescribed number of scan pulses to the scan electrode lines within each driving cycle by the plurality of driving blocks, wherein the applying the prescribed number of scan pulses comprises, (1) applying a first scan pulse to a first driving block in said each driving cycle starting from a first scan electrode line to a (n)th scan electrode line in a first prescribed sequence; and (2) applying a second scan pulse to a second driving block starting from a first scan line to a (m)th scan line in a second prescribed sequence, wherein the prescribed number of address periods for scan pulses are within said each driving cycle, and wherein a sequence of driving blocks to address periods changes for each cycle.

32. The method of claim 30, wherein the cycle is one of a driving cycle, a multiple of the driving cycle, and a sub-field of a frame.

* * * * *